US012454956B2

(12) United States Patent
Kacin

(10) Patent No.: US 12,454,956 B2
(45) **Date of Patent: *Oct. 28, 2025**

(54) GAS SEAL COLUMN APPARATUS WITH SENSOR COLUMN

(71) Applicant: GSCD Corp., Miami, FL (US)

(72) Inventor: William Louis Kacin, Northport, NY (US)

(73) Assignee: GSCD CORP., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/180,539

(22) Filed: Apr. 16, 2025

(65) Prior Publication Data

US 2025/0243866 A1 Jul. 31, 2025

Related U.S. Application Data

(63) Continuation-in-part of application No. 19/020,152, filed on Jan. 14, 2025, which is a continuation of application No. 18/819,249, filed on Aug. 29, 2024, now Pat. No. 12,196,212, which is a continuation-in-part of application No. 18/680,008, filed on May 31, 2024, which is a continuation of (Continued)

(51) Int. Cl.

| | |
|---|---|
| ***F04D 25/04*** | (2006.01) |
| ***F04D 15/00*** | (2006.01) |
| ***F04D 29/053*** | (2006.01) |

(52) U.S. Cl.

CPC ..... *F04D 25/04* (2013.01); *F04D 15/0083* (2013.01); *F04D 29/053* (2013.01)

(58) Field of Classification Search

CPC ..... F04D 25/04; F04D 15/0083; F04D 29/053

See application file for complete search history.

(56) References Cited

U.S. PATENT DOCUMENTS

| | | | |
|---|---|---|---|
| 2,959,133 | A | 11/1960 | Erwin |
| 3,255,702 | A | 6/1966 | Gehrm |

(Continued)

FOREIGN PATENT DOCUMENTS

| | | | |
|---|---|---|---|
| BE | 664725 | A | 9/1965 |
| JP | H02215999 | A | 8/1990 |

OTHER PUBLICATIONS

Office Action issued by the USPTO in relation to U.S. Appl. No. 17/205,124 dated Mar. 16, 2023 (15 pages).

(Continued)

*Primary Examiner* — Brian O Peters

(74) *Attorney, Agent, or Firm* — CARTER, DELUCA & FARRELL LLP

(57) ABSTRACT

A gas seal column apparatus includes a pump drive motor, a gas seal column, a pump system, a level sensor, and a control box. The gas seal column receives a seal gas for pressurizing the gas seal column. The pump system includes a pump and the gas seal column. The pump system is coupled to the pump drive motor and moves a product through the pump. The level sensor is supported on a sensor column that is separate from the gas seal column to detect a level of the product in the gas seal column and any fumes in the gas seal column. The control box is in communication with the level sensor and controls the seal gas received within the gas seal column and the sensor column to control an amount of fumes and the level of the product within the gas seal column.

22 Claims, 6 Drawing Sheets

Related U.S. Application Data application No. 18/410,703, filed on Jan. 11, 2024, now Pat. No. 12,117,010, which is a continuation-in-part of application No. 17/205,124, filed on Mar. 18, 2021, now abandoned.

(56) References Cited

U.S. PATENT DOCUMENTS

| | | | | |
|---|---|---|---|---|
| 3,513,942 | A | 5/1970 | Sato | |
| 4,065,232 | A | 12/1977 | Stratienko | |
| 4,596,510 | A | 6/1986 | Arneth et al. | |
| 5,263,825 | A * | 11/1993 | Doolin | F04D 29/108 417/423.1 |
| 6,086,331 | A * | 7/2000 | Halkjær | F04D 15/0077 417/372 |
| 2005/0134125 | A1 * | 6/2005 | Kim | H02K 5/203 310/58 |
| 2015/0143892 | A1 | 5/2015 | Cummings | |

OTHER PUBLICATIONS

Office Action issued by the USPTO in relation to U.S. Appl. No. 17/205,124 dated Nov. 9, 2022 (14 pages).

Office Action dated Apr. 24, 2024, issued in related Swiss Application No. CH001026/2023, 2 pages and English translation, 1 page, total 3 pages.

Extended European Search Report issued by the European Patent Office in relation to European Application No. 21931894.6 dated Jan. 14, 2025 (9 pages).

Korean Office Action for Application No. 10-2023-7035737 dated Jul. 15, 2025 with English translation, 14 pages.

* cited by examiner

GAS SEAL COLUMN APPARATUS WITH SENSOR COLUMN

CROSS-REFERENCE TO RELATED APPLICATIONS

This application is a continuation-in-part of U.S. patent application Ser. No. 19/020,152, filed Jan. 14, 2025, which is a continuation of U.S. patent application Ser. No. 18/819,249, filed Aug. 29, 2024, which is a continuation in part of U.S. patent application Ser. No. 18/680,008, filed May 31, 2024, which is a continuation of U.S. patent application Ser. No. 18/410,702, filed Jan. 11, 2024, and which is a continuation-in-part of U.S. patent application Ser. No. 17/205,124, filed Mar. 18, 2021, the entire disclosure of each of which is incorporated herein by reference.

TECHNICAL FIELD

The present application relates to a gas seal column apparatus.

BACKGROUND

Vertical pumps that have high-temperature applications are known. However, such pumps typically apply standard pump components that do not permit elongation or shortening through a telescoping feature.

In the pumping world dominated by horizontal pumps, mechanical seals or shaft packing glands are the most troublesome and highest maintenance cost items over all other pump components.

SUMMARY

The answer to eliminating these problems and their associated expenses is to remove both components (mechanical seals and packings glands) and reposition the pump components vertically with a gas seal column encasing a drive shaft between a pump drive motor and a pump. The gas seal column and the pump may form a sealed unit that is pressurized for product containment. The gas seal column uses gravity and gas pressure to control the level of the product in the column, where it performs as a seal around the shaft. In order to pressurize the gas seal column a closure is required at the top of the gas seal column. This invention will describe two ways to do that. The first way is to use a motor with a sealed housing and seal it to the top of the gas seal column and a pump casing sealed to the bottom of the gas seal column, resulting in a pressurized, sealed, vertically oriented pumping system. The second way is to install a gas shaft seal at the top of the pump envelope that includes the gas seal column sealed to a pump casing. When the shaft of a suitable motor is installed into the gas shaft seal and the motor secured to the pump envelope, the gas seal column system will perform as described in the disclosure.

Elevated temperature applications may require a corrosion-resistant, lined, metallic, outer column, or for special applications, a metallic outer column supporting a telescoping, high-temperature, corrosion-resistant liner described herein.

These numerous benefits listed above, and other numerous benefits listed herein, may be realized by utilizing the disclosure:

With a gas seal column there is no contact between rotating and stationary components of the pump, thereby allowing for a continuous run dry capability. Run dry capability may result in the elimination of friction, heat, mechanical wear, power loss, high initial cost, installation cost, replacement cost, and collateral damage cost of mechanical seal and packing when they inevitably fail and significantly reduces the possibility of product leakage requiring cleanup and reporting to an oversight or authoritative body.

A gas seal column, through the use of product monitoring sensors, also allows for continuous, timely, pump prime sensing and start up, product control, reporting, operator alerting, and, if needed, controlled automatic shutdown of pumping operations to prevent equipment and collateral damage. In contrast, seal and packing failures may announce themselves with a large puddle on the floor.

Combining a gas seal column with sealing all pump components of the pumping system together in a vertically-oriented pump envelope allows for:

a. Improved internal atmosphere control to prevent corrosion of internal components, especially motor bearings.
b. Improved product control with essentially no possibility of product escaping the containment envelope, possibly causing employee injury or nearby equipment damage.
c. In many cases, eliminating the cost of a bearing pedestal by using a sealed extended shaft motor with a corrosion resistant sleeve to protect the extended motor shaft.
d. Operation at higher temperatures may be accomplished by utilizing a corrosion resistant liner inside a metallic support column similar to lined pipe and pumps currently on the market, and for special application, by utilizing a structural metal column with a telescoping corrosion resistant liner as herein described.
e. In cases where a monolithic corrosion resistant fixed-length column cannot be used, the liner or a telescoping liner can be used.

Considering all of the above it can easily be expected that the total life cycle cost of a gas seal column, especially a structural metal column with a telescoping corrosion resistant liner optimized for use in elevated temperature situations, will be significantly lower than for a similar performing mechanical seal or packing pump.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
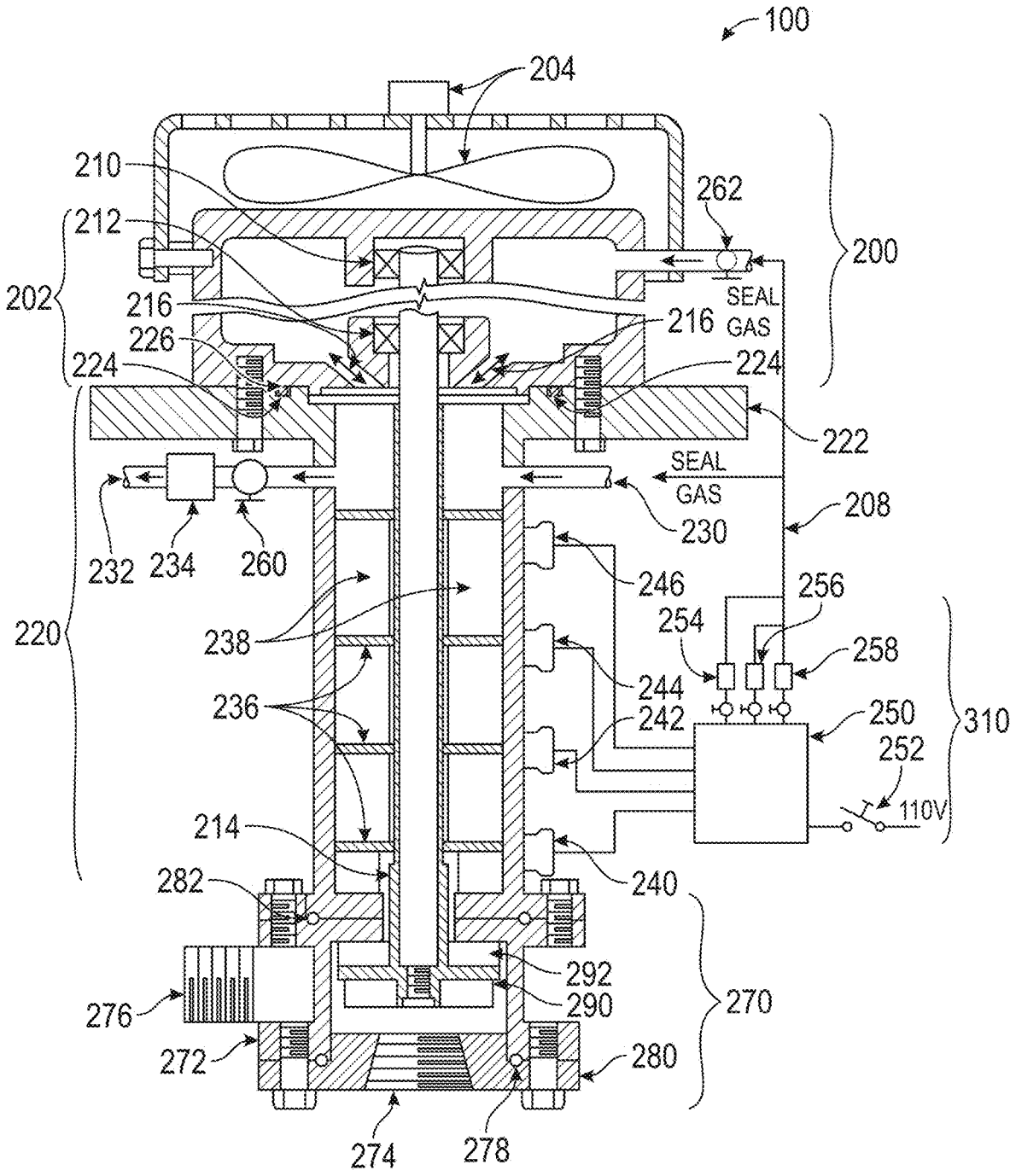
FIG. 1 is a cross-sectional view of a gas seal column apparatus consistent with certain embodiments of the present disclosure and illustrating a sealed pump drive motor with an external fan and gas passage ports, a gas seal column, a control box, and a pump of the gas seal column apparatus.

While this disclosure is susceptible of embodiment in many different forms, there is shown in the drawings and will herein be described in detail specific embodiments, with the understanding that the present disclosure of such embodiments is to be considered as an example of the principles and not intended to limit the disclosure to the specific embodiments shown and described. In the description below, reference numerals are used to describe the same, similar, or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

The gas seal column apparatus of this disclosure may comprise a sealed pump drive motor, a gas seal column, a control box, and a pump. The pump drive motor may comprise a pump drive motor and a cooling fan. The pump drive motor may comprise a drive shaft that is extended to reach the pump through the gas seal column. The pump drive motor may further comprise a pressurized housing. The cooling fan may be mounted to the pump drive motor externally to cool the pump drive motor instead of driving a fan from an extension of the drive shaft of the pump drive motor through the top of the pump drive motor. Alternatively, ducted cooling from a remote source may be used to cool the pump drive motor.

The seal gas may be clean and pressurized and may be sourced locally or remotely. The first choice for the seal gas would be clean air that is free of corrosive fumes. Alternatively, a specialized gas may be used if air is incompatible with a product being pumped. If the seal gas that is selected to be used cannot be released to the environment after use because of cost, toxicity, contamination, or other reasons then the seal gas may be directed to a local gas treatment system or collected in a tank for later treatment. After treatment, the seal gas may be reused or disposed of.

The gas seal column may be operable to encase the drive shaft component of the pumping system and may function as a replacement for mechanical seals and packing by using pressure of the seal gas to control a product level within the gas seal column, during startup, when pumping, during shutdown, or in standby when gas seal column controls are activated.

The gas seal column may comprise a top mounting panel at the top end of the gas seal column. A circular groove in the top mounting panel may capture a first O-ring which is operable to pressure seal the interface between the sealed pump drive motor and the gas seal column.

An inlet pipe connection and a discharge pipe connection may allow the seal gas to flow in and out of the gas seal column. In front of the discharge valve in the discharge pipe, there may be a manually-operated purge valve, which may be adjusted upon initial system setup. Purge gas is a constantly running, low-flow rate, seal gas designed to allow seal gas to exit to remove any fumes from the gas seal column.

In an application where there is a sudden change of pressure in the product supply line (such as when the pump drive motor switches from 'on' to 'off'), the product being pumped may surge into the gas seal column in a turbulent manner.

The gas seal column may or may not comprise an assembly of Splash Quieting Discs (SQDs) and Anti-Rotation Panels (ARPs). Each SQD is a structural element that may be formed as a disc with an outside diameter that is an easy slip fit into the gas seal column and with an inside diameter slightly larger than the shaft that will pass through it to ensure no contact with the shaft. The SQDs may be perforated as needed to allow for passage of the product. While described as a disc, each SQD may function as a porous horizontal barrier to the product and consequently may be made in a large variety of different structural configurations, including, but not limited to, discs, coils, cylinders, mesh, or other structures, that still fall within the spirit of the disclosure.

ARPs are vertical structural elements that may have a width the same as the outside radius minus the inside radius of the SQDs.

Figure 4:
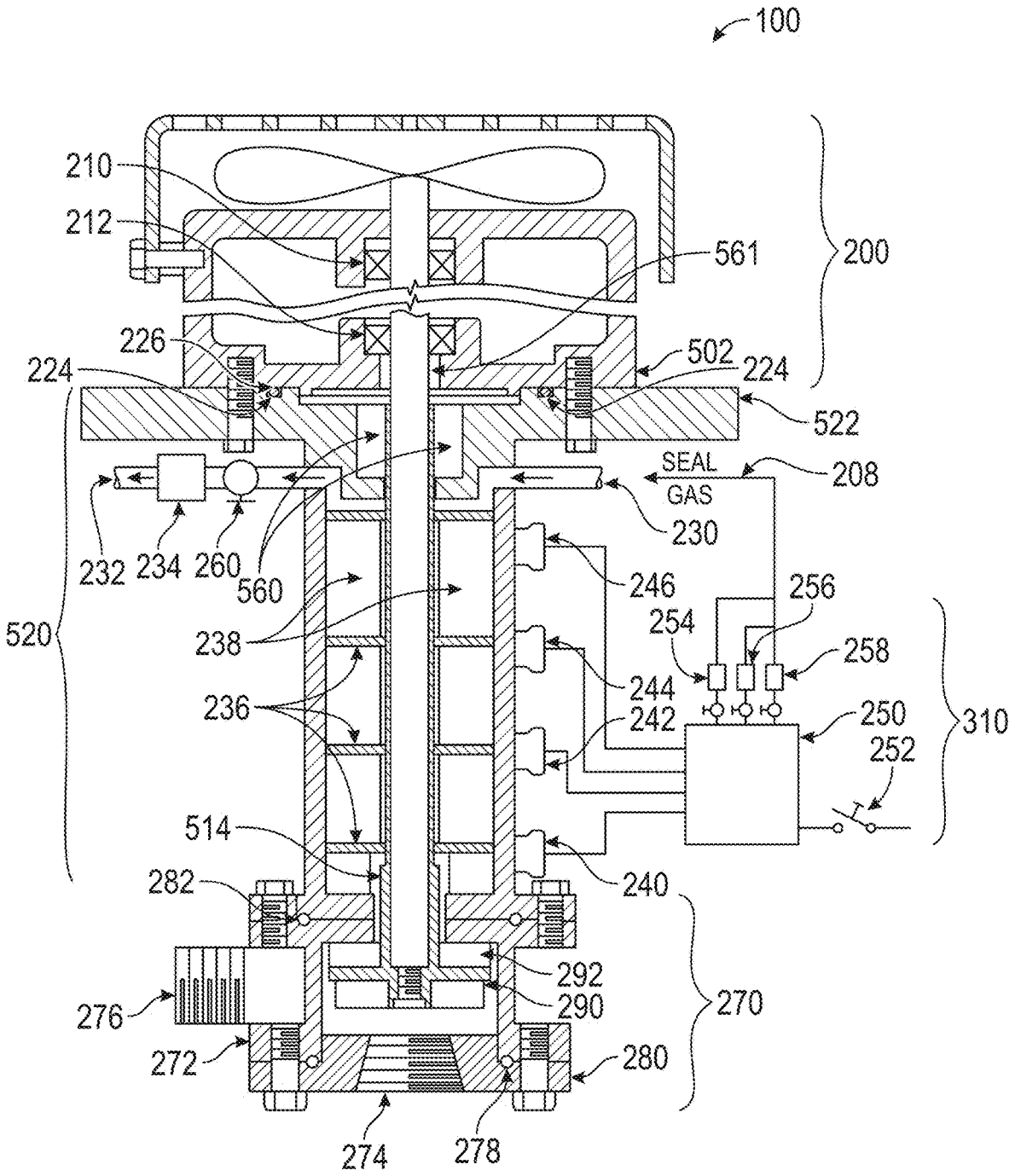
FIG. 4 is a cross-sectional view of a gas seal column apparatus consistent with certain embodiments of the present disclosure and illustrating a gas seal column with a gas shaft seal and a pump joined together to create a sealed envelope of the gas seal column apparatus. The gas seal column of the gas seal column apparatus may be connected to an unsealed pump drive motor and a control box.

SQDs may be attached to and separated by ARPs and positioned and fastened at a right angle to the flat plane of the SQD, as shown in FIGS. 1 and 4. The number of SQDs, and the number of ARPs, and the angular separation on the face of the SQDs may be determined by the application. Three sets of ARPs may be of the same height and fastened at each end to an SQD. The bottom set of ARPs may be fastened only to the underside of the bottom SQD and the height is adjusted to suit that particular column length. For ease of manufacture, the SQDs and the ARPs may be assembled and fastened together outside the gas seal column before the entire assembly is installed through a slip fit into the gas seal column and secured to prevent movement of each element of the assembly.

With an SQD and ARP assembly in place, the product being pumped may rapidly fill the cavity below the bottom SQD. The product will gradually fill up the cavity below the second SQD, below the third SQD, and so on because of the small clearances between the SQD, the column and the shaft, and depending upon the type and number of perforations in the SQD. In this way the SQDs prevent splashing damage to components such as the gas shaft seal (e.g., in an unsealed motor embodiment), or shaft ball bearings (e.g., in a sealed motor embodiment), and allow time for the product control system to react as needed to minimize or prevent damage.

The gas seal column may comprise a plurality of level sensors. The plurality of level sensors may detect the product level within the gas seal column, may report the product level to the control box, and may control the product level. Based upon input from the plurality of level sensors, the control box may be adapted to monitor the product level, may report the product level, may alert an operator, and may control the product level of the product that may come into the gas seal column during operating and standby conditions, when the control box is energized by a control switch. As a non-limiting example, the control box may be adapted to alert the operator by activating flashing indicators, sending text messages, pages, or emails, sounding audible transducers, or combinations thereof if the product level exceeds a predetermined alert threshold. As a further non-limiting example, the control box may shut down the pump drive motor and possibly other components if the product level exceeds a predetermined shutdown threshold.

The gas seal column is designed to operate continuously in benign applications and extremely harsh applications that quickly destroy the best mechanical seals. Sensors are a key and important component of the gas seal column and sensors will be selected to meet these harsh conditions. There are literally dozens of sensor types and styles that can and will be used by pump manufacturers. Some of the most popular are float switches, capacitive sensors, contact probe sensors, pressure sensors, optical switches, and the like. Each of these may have its own specific mounting and column penetration requirements for successful operation.

The number and type of sensors used will be determined by the application. In the embodiment shown there may be four level sensors. The four level sensors may be equally spaced in relation to the gas seal column. A first level sensor may be located at the lowest level of the gas seal column. A second level sensor, a third level sensor, and a fourth level sensor may be located above the first level sensor in that order, with the fourth level sensor being at the highest acceptable level in relation to the gas seal column.

At pump start up, the control switch may be activated manually or automatically. Responsive to an activation of the control switch, the control box may begin a low volume seal gas flow throughout the system by opening a first inlet valve and leaving a second valve and a third inlet valve closed. In some embodiments, the opening and closing of the first inlet valve, the second inlet valve, the third inlet valve, and the discharge valve may be controlled by the control box.

In some embodiments, the first inlet valve, the second inlet valve, and the third inlet valve may provide differing flow rates of the seal gas when in the open state. The differing flow rates may result in differing pressures applied to the product within the gas seal column. At 'initial system setup', a purge valve 260 near a discharge valve 234 may be manually adjusted to establish purge gas flow rate. The smallest flow rate, and therefore the lowest pressure on the product within the gas seal column, may result from having only the discharge valve 234 opens when the control box is switched on. The highest flow rate, and therefore the highest pressure on the product within the gas seal column, may result from having all gas inlet valves open and the discharge valve closed.

The control box may become aware that the product has entered the gas seal column when the first level sensor detects the product and opens the first inlet valve. If the product continues to rise and is detected by the second level sensor, the control box may attempt to stop the product from rising further in the gas seal column by opening the second inlet valve, thereby increasing the pressure of the seal gas within the gas seal column. If this works and the product level drops, then the second level sensor may reflect that the product is no longer contacting the second level sensor. However, the control box may retain the first and second inlet valves in the open state. When the first level sensor indicates that the product level has dropped below the first level sensor, the control box may close both of the inlet valves.

Alternatively, if the product level continues to rise above the second level sensor and is detected by the third level sensor, the control box may open the third inlet valve, thus releasing an even higher flow of gas into the gas seal column to further increase gas pressure to push the product down in the gas seal column. The control box may additionally be adapted to send an alert to the operator reporting that the product is appearing at a higher level in the gas seal column than is normally expected. The higher level of gas flow will continue until the product is driven down to the first level sensor which will close the first inlet valve, the second inlet valve, and the third inlet valve.

Alternatively, if the product level continues to rise and is detected by the fourth level sensor, the control box may be adapted to initiate a controlled, complete shutdown of the system, sound and display an alarm, and close all valves to maintain the sealed integrity of the total pump housing (e.g., in a sealed motor embodiment) and the sealed integrity of the "pump envelope" containing a gas shaft seal (e.g., in an unsealed motor embodiment) to prevent equipment damage or other collateral damage from occurring. This shutdown sequence allows the operator to investigate what is causing the condition and to correct the problem.

The first level sensor may be located slightly above the minimum priming level for the pump. When the pump is stopped, inlet or outlet conditions may cause the product to rise or drop in the gas seal column. A rise in the product level may be controlled as previously described. Responsive to a drop in the product level below the first level sensor, the control box may close the first inlet valve. Closing the first inlet valve may stop seal gas flow until the product once again rises to reach the first level sensor. The control box may function in this manner whether the pump is operating or in standby mode as long as the control box is activated. In aspects, the gas seal column may be configured without a control box.

The description of sensor and control presented herein is by way of illustration only. There are many other sensing and control techniques that may be applied which a person having ordinary skill in the art will recognize as falling within the spirit and scope of the disclosure.

The pump may comprise a dual impellor to move the product. An auxiliary impellor may be mounted on the back of a main impellor. The auxiliary impellor may be a larger diameter than the main impellor. The auxiliary impellor may constitute a hydrodynamic shaft seal and may prevent the flow of the product into the gas seal column during pumping operations.

The drive shaft may be a sleeved shaft to protect the drive shaft from corrosion.

Figure 3:
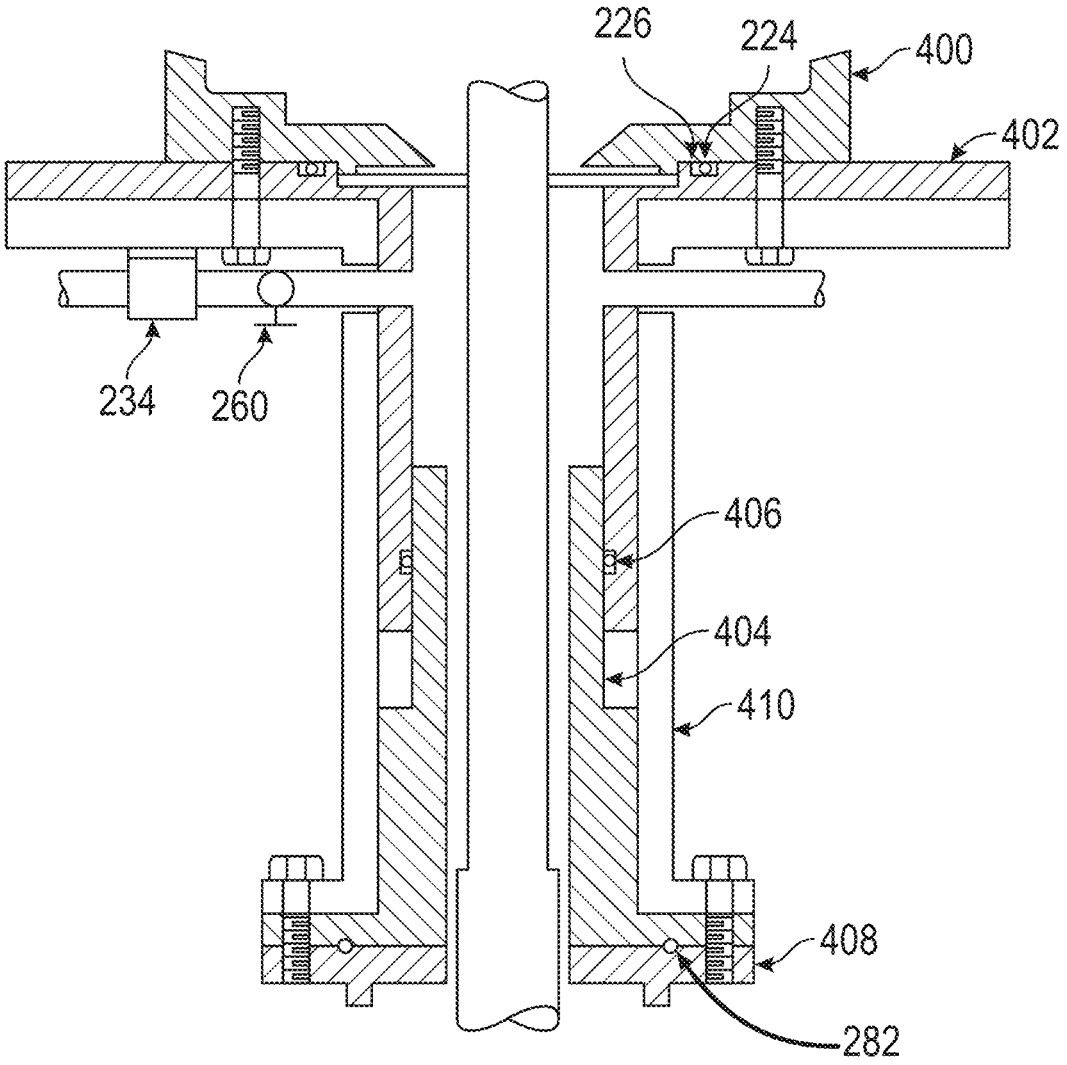
FIG. 3 is a cross-sectional view of a gas seal column apparatus having a telescoping liner consistent with certain embodiments of the present disclosure and illustrating a pump drive motor, a gas seal column with a telescoping liner, and a pump of the gas seal column apparatus.

In some applications, the pump may require operation at an elevated temperature. In those cases where growth in the length of a monolithic corrosion resistant column might interfere with pump operation, a lined version of the gas seal column can be used. In FIG. 3 the outer column maintains the structural integrity required for reliable pump operation and a two-part telescoping liner maintains the hermetic seal and corrosion resistance requirements of the application.

Alternatively, if available, and suitable for the application, a bellows liner could be used in place of the telescoping liner.

The pumping system shown in FIG. 1 using an extended shaft is for illustration only. A person having ordinary skill in the art will recognize that various arrangements of the drive shaft may fall within the spirit and scope of the disclosure as long as the pump drive motor is coupled to the pump via a shaft in the gas seal column.

FIG. 1 also illustrates an embodiment that allows the end user to permit or prevent seal gas to flow through the sealed motor housing by fully opening or closing manual gas valve 262 in seal gas inlet pipe 206 or adjusting the seal gas flow rate to the purge gas level desired.

Figure 2:
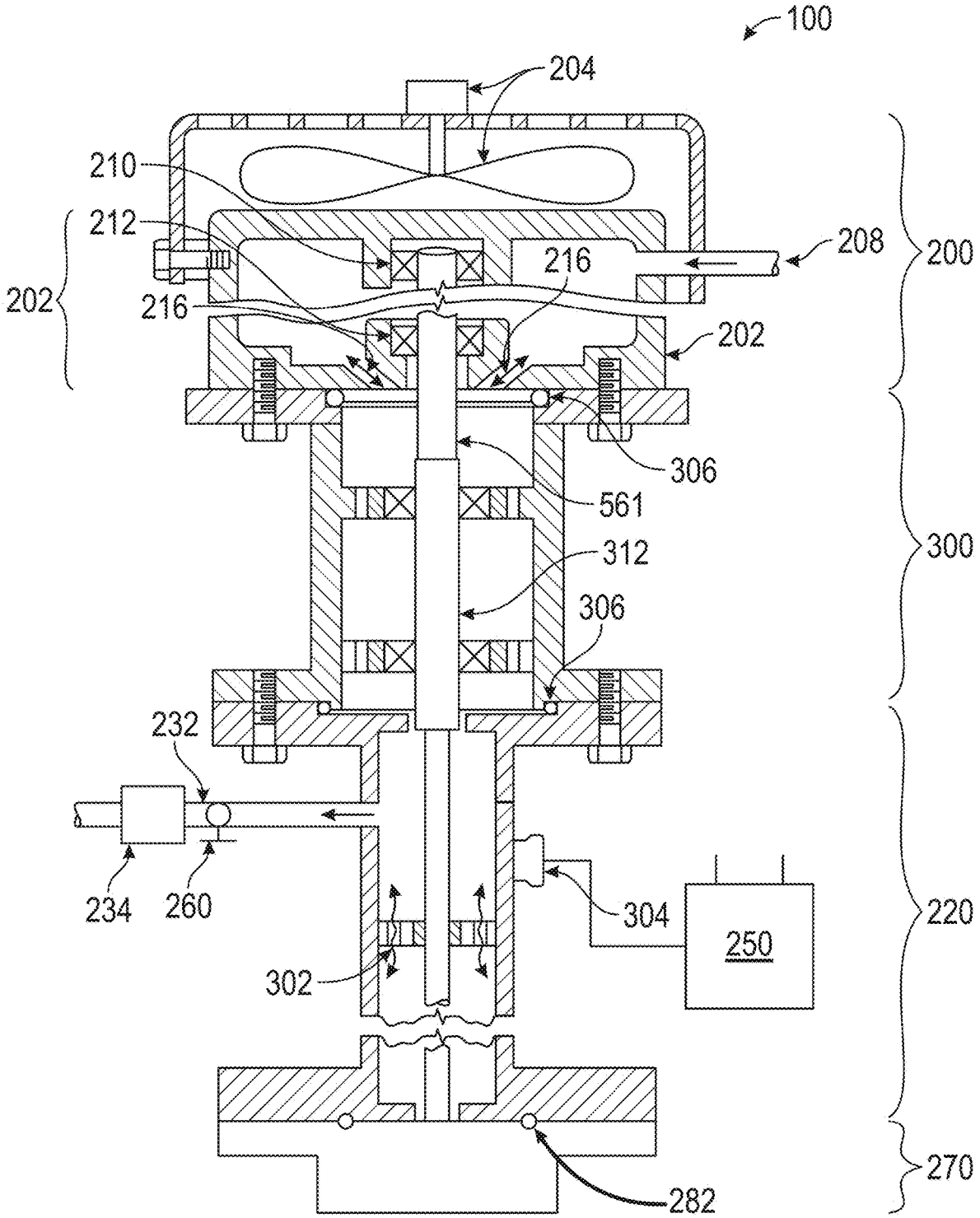
FIG. 2 is a cross-sectional view of a gas seal column apparatus consistent with certain embodiments of the present disclosure and illustrating a bearing shaft adapter, a sealed pump drive motor, a gas seal column, and a pump of the gas seal column apparatus.

Referring to FIG. 2, some applications may require a special shaft of length, diameter, or material of construction not available in an extended shaft sealed pump drive motor. Applications requiring the drive shaft and the gas seal column to be longer may be accomplished by using a bearing shaft adapter between the sealed pump drive motor and the gas seal column. The bearing shaft adapter may couple and seal both the pump drive motor and the gas seal column such that the assemblage of the pump drive motor, the bearing shaft adapter, the gas seal column, and the pump are sealed. The gas seal column may be of any practical length and designed with a plurality of shaft bearing supports and level sensors in relation to the length of the gas seal column to satisfy the requirements of the application.

Figure 2A:
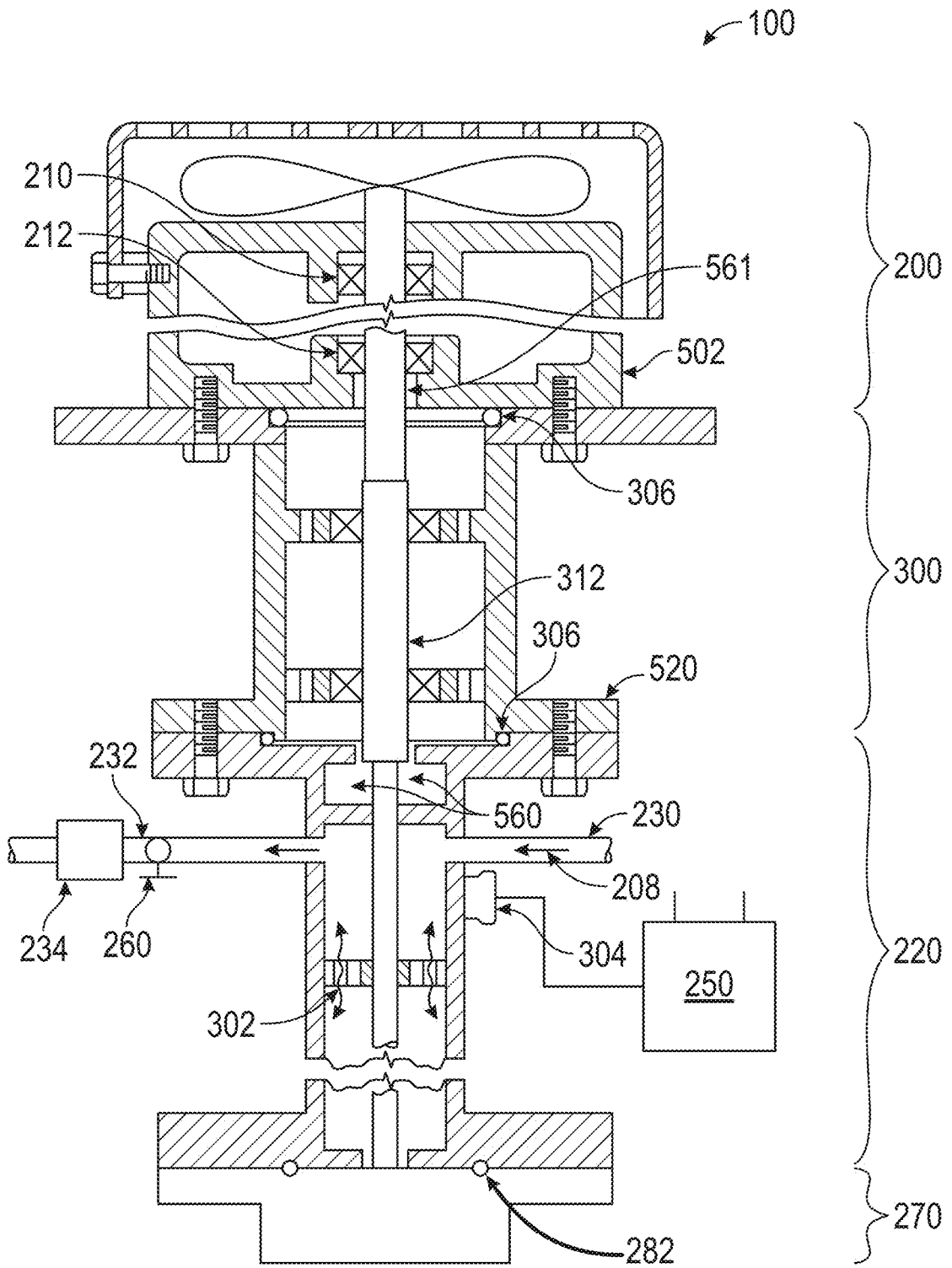
FIG. 2*a* is a cross-sectional view of a gas seal column apparatus consistent with certain embodiments of the present disclosure and illustrating a bearing shaft, an unsealed pump drive motor, a gas seal column with a gas shaft seal, and a pump of the gas seal column apparatus.

Referring to FIG. 2*a*, some applications may require a gas shaft seal in the space 560 to satisfy the requirements of the application. Some applications may also require a special shaft of length, diameter, or material of construction not available in an extended shaft unsealed pump drive motor. Applications requiring the drive shaft and the gas seal column to be longer may be accomplished by using a bearing shaft adapter between the unsealed pump drive motor and the gas seal column. The gas seal column may be of any practical length and designed with a plurality of shaft bearing supports and level sensors in relation to the length of the gas seal column to satisfy the requirements of the application.

Since a sealed unit encloses a fixed volume of empty space, the sealed unit passively assists in controlling the level of the product trying to rise in the gas seal column. Passive assistance may result from Boyles Law which states that "the pressure of an ideal gas is inversely proportional to the volume of the ideal gas at a constant temperature".

a. $P1 \times V1 = P2 \times V2$ b. where P1 is a first pressure, c. V1 is a first volume, d. P2 is a second pressure, and e. V2 is a second volume.

Simply put—if you halve the available volume of a fixed amount of gas you will double the pressure. In accordance with Boyle's Law, as the volume available for the seal gas is reduced, the pressure of the seal gas increases, and the seal gas may become more effective in countering the rise of the product.

As experience is gained through the introduction and application of this invention consideration should be given to the operational benefits that might be optimized by decreasing empty space in the internal shape and size of the gas seal column around the drive shaft, all of which may affect system response time.

Turning now to FIG. 1, a cross section of the gas seal column apparatus 100 through the sealed pump drive motor 200 and any gas passage ports 216, the gas seal column 220, and the pump 270 is shown. In aspects, gas seal column apparatus 100 may include a sealed pump drive motor with or without gas purging through the sealed pump drive motor as controlled by manual gas valve 262. In embodiments with sealed pump drive motors without gas purging through the sealed pump drive motor, the product may be a non-corrosive product. The sealed pump drive motor 200, the gas seal column 220, and the pump 270 may be sealed to each other to define a vertically-oriented pump system. As non-limiting examples, the circular groove 224 on the top mounting panel 222, the first O-ring 226, the second O-ring 278, the cover plate 280, the pump casing 272, and the third O-ring 282 may prevent air, the seal gas 208, and the product from leaking in or out. The pump drive 200 may comprise the sealed pump drive motor 202 and the cooling fan 204.

The gas seal column controls 310, comprising the control box 250, the first inlet valve 254, the second inlet valve 256, and the third inlet valve 258, may control the flow of the seal gas 208 into the gas seal column apparatus 100 when activated by the control switch 252. The seal gas 208 may be introduced into the gas seal column 220 via an inlet pipe 230 (e.g., a gas inlet pipe) and may exit the gas seal column 220 via the discharge pipe 232. The seal gas 208 may pressurize the gas seal column 220 to force the product downwards. The gas pressure may be regulated by the control box 250 by opening and closing the first inlet valve 254, the second inlet valve 256, and the third inlet valve 258 (e.g., each of which may be referred to as seal gas inlet valves in certain embodiments). The rate of seal gas that exits the gas seal column may be controlled by manual valve 260 and the discharge valve 234 may prevent or permit the seal gas 208 from exiting the gas seal column 220 and may also be under control of the control box 250. The control box 250 may also control power to the pump drive motor 202 such that the control box 250 may shut down the system if necessary.

The first level sensor 240, the second level sensor 242, the third level sensor 244, and the fourth level sensor 246 may detect the product level within the gas seal column 220 and may report the product level to the control box 250.

The drive shaft 214 may turn the main impellor 290 in the pump 270 to move the product from the product inlet 274 to the product outlet 276. The auxiliary impellor 292 may be coupled to the main impellor 290 and may constitute a hydrodynamic seal to resist the flow of the product into the gas seal column 220. The gas seal column 220 may comprise the plurality of anti-rotation panels 238 and the plurality of splash quieting discs 236.

Turning now to FIG. 2, a cross section of the gas seal column apparatus 100 through the sealed pump drive motor 200, the gas seal column 220, the bearing shaft adapter 300, and the pump 270 is shown. The bearing shaft adapter 300 may enable the introduction of the special shaft 312 when necessary. The plurality of level sensors 304 may detect the product level within the gas seal column 220 and may report the product level to the control box 250 as in FIG. 1. The seal gas 208 may flow through the apparatus 100 as described in FIG. 1. As a non-limiting example as shown in FIG. 2A, the seal gas 208 may enter the gas seal column 220 via the gas inlet pipe connection 230 and exit at the discharge pipe connection 232 as enabled by the gas discharge valve 234. The seal gas 208 may flow through the plurality of shaft bearing supports 302 to push the product level down to whatever product level is required for the gas seal column 220. O-ring 306 may seal the sealed pump drive motor to the bearing shaft adapter.

Turning now to FIG. 2*a*, a cross section of an embodiment of an unsealed motor housing 502, a gas seal column 220, a bearing shaft adapter 300, and a pump 270 is shown. The top mounting panel of the gas seal column 220 is modified to provide space 560 for a gas shaft seal to be used in conjunction with special shaft 312. FIG. 2*a* illustrates drive motor 200, bearing adapter 300, gas seal column 220, and pump 270 all fastened together. Gas seal column 220 and pump casing 270 are sealed together by "O" ring 282. When special shaft 312 slides through the gas shaft seal mounted in space 560, it completes a sealed pressurized cavity consisting of seal gas column 220 and pump 270 ready for pump operation.

Turning now to FIG. 3, a cross section of the gas seal column with a telescoping liner shows the pump drive motor 400 sealed to the top section 402 of the telescoping liner and the lower section 404 of the telescoping liner sealed to the pump casing 408. Both liners are sealed by "O" ring 406 contained in a groove in the top section 402 of the liner and enables vertically oriented linear telescoping between the two liners to enable thermal expansion and contraction during temperature changes. The two-part telescoping liner adjusts vertically through a vertical sliding connection between the top section 402 of the telescoping liner and the lower section 404 of the telescoping liner with "O" ring 406 maintaining integrity against leaks of gas, fluid, or any other material contained within the telescoping liner. All of the telescoping components are contained within structural column 410.

In an embodiment (see e.g., FIG. 4), the pump device herein described may use a wider variety of readily available motors or other means to rotate a vertical shaft as the driving mechanism, which may be used in conjunction with a gas shaft seal installed in space 560.

As seen in FIG. 4, the gas seal column and the pump casing may be sealed together at their interface and, in conjunction with a gas shaft seal mounted in space 560 in the top mounting panel 522 of the gas seal column. This constitutes a sealed enclosure when the unsealed pump drive motor shaft is slid through the gas shaft seal and the unsealed pump drive motor is secured to the top mounting panel 522.

More specifically, FIG. 4, illustrates a cross-section of an embodiment in which the pump casing 272 is sealed to the lower panel of the gas seal column 520 by O-ring 282. The top mounting panel 522 of the gas seal column 520 is modified to provide space 560 for a gas shaft seal to be used in conjunction with the motor shaft 561 and any type of motor 502 suitable for the application. With the motor shaft 561 assembled with the appropriate gas shaft seal and the motor 502 secured to the top mounting panel 522, the gas seal column and the pump are a sealed pump envelope with a pump drive motor 502 attached. The drive shaft corrosion resistant sleeve 514 is shortened to allow room for the inclusion of a gas shaft seal. Such an embodiment includes the product handling features of this disclosure.

Figure 5:
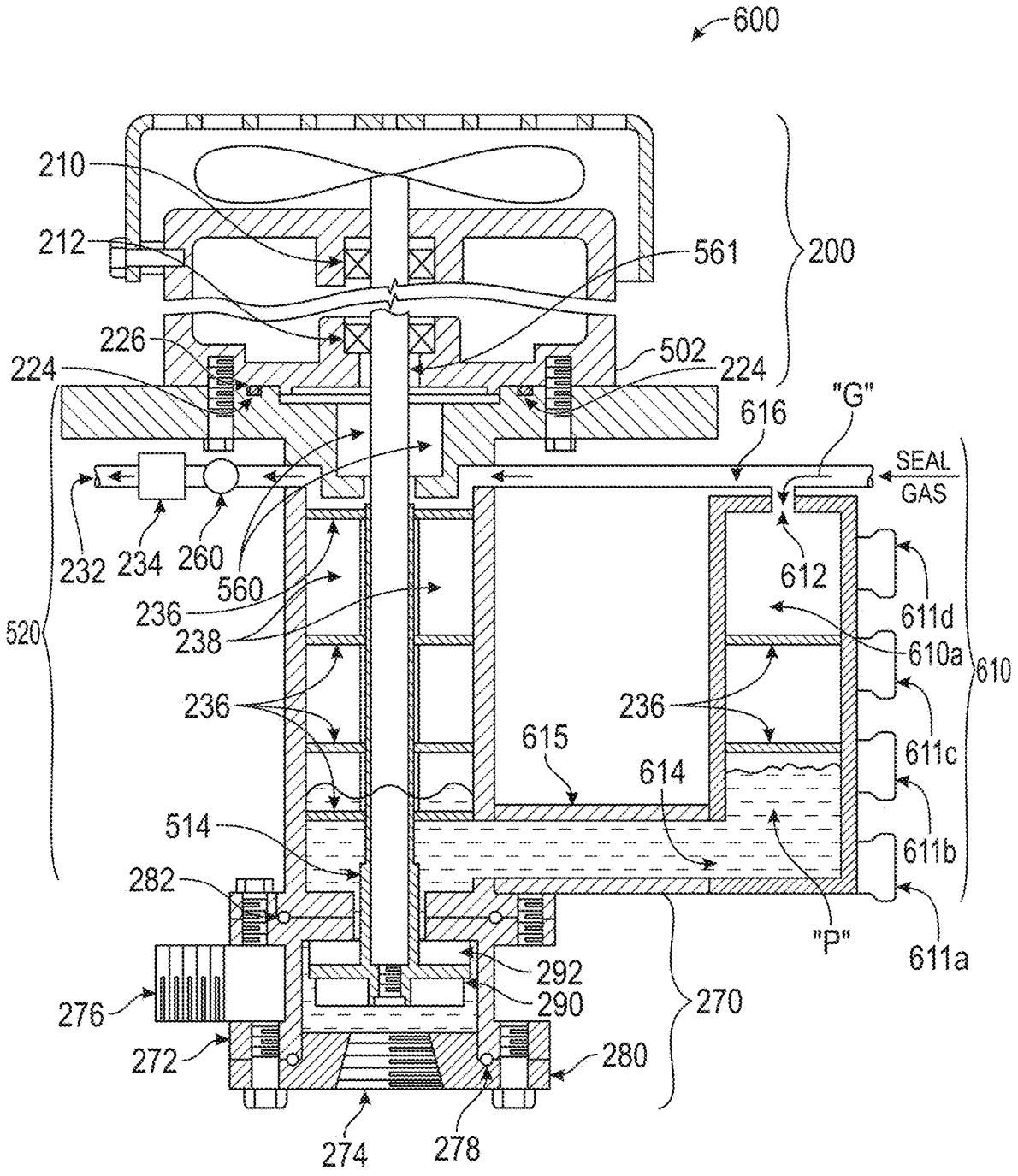
FIG. 5 is a cross-sectional view of another gas seal column apparatus consistent with certain embodiments of the present disclosure, the gas seal column apparatus including a sensor column that is separate from a gas seal column.

With reference to FIG. 5, another gas seal column apparatus 600 is substantially similar to gas seal column apparatus 100 (in FIG. 4), but includes a sensor column 610 that is separate (e.g., discrete/distinct) from a gas seal column 520 (and separate from the motor shaft 561 thereof). Although sensor column 610 is shown spaced from gas seal column 520, sensor column 610 can be disposed in any relationship and/or distance relative to gas seal column 520. For instance, in some aspects, sensor column 610 can be disposed in close proximity to and/or connected to and/or integral with and/or part of (e.g., partitioned from) gas seal column 520. In some aspects, sensor column 610 can be retrofit to any suitable gas seal column apparatus. The sensor column 610 functions as a level gauge for the gas seal column 520. The sensor column 610 provides increased accessibility (e.g., six-sided accessibility) for cooperating with one or more sensors 611 (e.g., 611*a*, 611*b*, 611*c*, 611*d*, etc.) which can include any number of sensors and/or any type of sensor, for sensing, for example, an amount of product "P" and/or seal gas "G" within the separate sensor column 610 to determine an amount of product "P", seal gas "G", and/or fumes within the gas seal column 520. The sensor column 610 enables any of the sensors 611 to be readily accessed, for example, through the top and/or side of the sensor column 610. In aspects, the sensor column 610 may include clear material to facilitate the use of optical sensors and visibility into an internal cavity 610*a* of the sensor column 610 for making quick determinations about, for example, the amount of product "P" within the gas seal column 520. The sensor column 610 also includes a gas input 612, which may be on an upper end portion thereof, for receiving seal gas "G" into, for example, the upper end portion of the sensor column 610. The gas input 612 is disposed in fluid communication with an inlet pipe 616 through which seal gas "G" passes. The sensor column 610 further includes a product input 614, which may be on a lower end portion thereof, for receiving product "P" (e.g., fluid) into the internal cavity 610*a* of the sensor column 610. The product input 614 is disposed in fluid communication with a product pipe 615 that extends between, for example, a lower end portion of the sensor column 610 and a lower end portion of the gas seal column 520, to provide the sensor column 610 in fluid communication with the gas seal column 520 and for enabling product "P" to be disposed in the gas seal column 520 and in the sensor column 610. In aspects, the gas input 612 and/or inlet pipe 616 may be smaller in diameter than the product input 614 and/or product pipe 615.

Various aspects and embodiments of the present disclosure are defined by the following numbered clauses:

1. A gas seal column apparatus comprising:
   - a vertically-oriented pump envelope including a gas seal column and a pump;
   - a pump drive motor configured to drive the pump envelope, the pump envelope and the pump drive motor configured to be sealed together;
   - a drive shaft encased by the pump envelope between the pump drive motor and the pump to couple the pump drive motor to the pump;
   - an inlet pipe configured to receive pressurized seal gas for introducing the seal gas into the pump envelope;
   - a discharge valve configured to enable the seal gas to exit the pump envelope; and
   - a seal inlet pipe and valve configured to permit or prevent or control the amount of seal gas to pass through a sealed motor housing.

2. The gas seal column apparatus according to clause 1, further comprising an inlet pipe connection that enables the seal gas to enter the pump envelope, and an outlet pipe connection that enables the seal gas to exit the pump envelope via the discharge valve, the pump envelope configured to enable the seal gas to displace corrosive fumes and a product, and wherein the gas seal column apparatus is configured to control a product level within the pump envelope by changing a pressure of the seal gas.

3. The gas seal column apparatus according to clause 2, wherein the gas seal column includes a plurality of level sensors which detects the product level within the gas seal column, and wherein the plurality of level sensors are positioned at differing heights.

4. The gas seal column apparatus according to clause 3, wherein the plurality of level sensors include a first level sensor, a second level sensor, a third level sensor, and a fourth level sensor;

wherein the first level sensor is located at a lowest level of the gas seal column and above a lowest level of the product needed for the pump to prime, and when activated, signals that the product has entered the gas seal column and the pump is primed for operation;

wherein the second level sensor is located above the first level sensor, and when activated, signals that an increase in the pressure of the seal gas is needed;

wherein the third level sensor is located above the second level sensor, and when activated, signals that a further increase in the pressure of the seal gas is needed and closes the discharge valve to further increase the pressure of the seal gas; and wherein the fourth level sensor is located above the third level sensor, and when activated, initiates a controlled shutdown of the pump or the entire apparatus.

5. The gas seal column apparatus according to clause 4, further comprising:

a control box to monitor the product level, to report the product level, to control the product level, and to operate the pump, wherein the control box monitors the product level via inputs from the plurality of level sensors.

6. The gas seal column apparatus according to clause 5, wherein the control box controls the product level by opening and closing a first inlet valve, a second inlet valve, a third inlet valve, the discharge valve, or combinations thereof.

7. The gas seal column apparatus according to clause 6, wherein the gas seal column further comprises a plurality of splash quieting discs, a plurality of anti-rotation panels, or a combination thereof to control motion of the product within the gas seal column.

8. The gas seal column apparatus according to clause 7, wherein the gas seal column further includes a telescoping, corrosion-resistant, lined gas seal column for elevated temperature conditions, and wherein the pump drive motor, the telescoping corrosion-resistant, lined gas seal column, and the pump define a sealed, vertically-oriented, pumping system.

9. The gas seal column apparatus according to clause 8, wherein a top mounting panel of the gas seal column is configured to receive a shaft seal to seal the gas seal column.

10. The gas seal column apparatus according to clause 9, wherein the pump includes a main impeller.

11. The gas seal column apparatus according to clause 10, wherein the pump further includes an auxiliary impellor coupled to the main impellor, wherein the auxiliary impellor is larger in diameter than the main impeller, wherein the auxiliary impellor is located closer to the gas seal column than the main impeller, and wherein the auxiliary impellor is operable as a hydrodynamic shaft seal to restrain or prevent the flow of the product into the gas seal column during pumping operations.

12. A gas seal column apparatus, comprising:

a pump drive motor;

a gas seal column configured to receive a seal gas for pressurizing the gas seal column;

a vertically-oriented pump system comprising a pump and the gas seal column, coupled to the pump drive motor and configured to move a product through the pump; and a plurality of level sensors to detect a level of the product in the gas seal column and any fumes in the gas seal column; and a fully sealed motor housing configured without a gas seal inlet pipe.

13. The apparatus according to clause 12, wherein the gas seal column includes an inlet pipe connection through which the seal gas enters the gas seal column.

14. The apparatus according to clause 13, wherein the gas seal column comprises a discharge pipe connection through which the seal gas exits the gas seal column via a discharge valve.

15. The apparatus according to clause 12, wherein the plurality of level sensors are positioned at different heights.

16. The apparatus according to clause 15, wherein the plurality of level sensors includes a first level sensor, a second level sensor, a third level sensor, and a fourth level sensor, wherein:

the first level sensor is at a lowest level of the gas seal column and above a lowest level of product needed for the pump to prime, and when activated, signals that the product has entered the gas seal column, and the pump is primed for operation;

the second level sensor is above the first level sensor, and when activated, signals that an increase in a pressure of the seal gas is needed;

the third level sensor is above the second level sensor, and when activated, signals that a further increase in the pressure of the seal gas is needed and closes the discharge valve to further aid in increasing seal gas pressure; and the fourth level sensor is above the third level sensor, and when activated, initiates a controlled shutdown of the pump.

17. The apparatus according to clause 12, wherein the gas seal column comprises a plurality of splash quieting discs, a plurality of anti-rotation panels, or combinations thereof to control motion of the product within the gas seal column.

18. The apparatus according to clause 12, further comprising a control box configured to monitor the product level via inputs from the plurality of level sensors, reports the product level, and controls the product level and operation of the pump.

19. The apparatus according to clause 18, wherein the control box controls the product level by opening and closing one or more valves.

20. The apparatus according to clause 12, wherein the pump includes a main impeller and an auxiliary impeller.

21. The gas seal column apparatus according to clause 14, further comprising an inlet pipe connection that enables the seal gas to enter the pump envelope, and an outlet pipe connection that enables the seal gas to exit the pump envelope via the discharge valve, the pump envelope configured to enable the seal gas to displace corrosive fumes and a product, and wherein the gas seal column apparatus is configured to control a product level within the pump envelope by changing a pressure of the seal gas.

22. The gas seal column apparatus according to clause 21, wherein the gas seal column includes a plurality of level sensors which detects the product level within the gas seal column, and wherein the plurality of level sensors are positioned at differing heights.

While certain illustrative embodiments have been described, it is evident that many alternatives, modifications, permutations and variations will become apparent to those skilled in the art in light of the foregoing description.

Persons skilled in the art will understand that the structures and methods specifically described herein and illustrated in the accompanying figures are non-limiting exemplary aspects, and that the description, disclosure, and figures should be construed merely as exemplary of aspects. It is to be understood, therefore, that the present disclosure is not limited to the precise aspects described, and that various other changes and modifications may be affected by one skilled in the art without departing from the scope or spirit of the disclosure. Additionally, it is envisioned that the elements and features illustrated or described in connection with one exemplary aspect may be combined with the elements and features of another without departing from the scope of the present disclosure, and that such modifications and variations are also intended to be included within the scope of the present disclosure. Indeed, any combination of any of the presently disclosed elements and features is within the scope of the present disclosure. Accordingly, the subject matter of the present disclosure is not to be limited by what has been particularly shown and described.

What is claimed is:

1. A gas seal column apparatus comprising:

a vertically-oriented pump envelope including a gas seal column and a pump;

a pump drive motor configured to drive the pump envelope, the pump envelope and the pump drive motor configured to be sealed together;

a drive shaft encased by the pump envelope between the pump drive motor and the pump to couple the pump drive motor to the pump;

an inlet pipe configured to receive pressurized seal gas for introducing the seal gas into the pump envelope;

a discharge valve configured to enable the seal gas to exit the pump envelope; and a seal inlet pipe and valve configured to permit or prevent or control an amount of seal gas to pass through a sealed motor housing.

2. The gas seal column apparatus according to claim 1, further comprising an inlet pipe connection that enables the seal gas to enter the pump envelope, and an outlet pipe connection that enables the seal gas to exit the pump envelope via the discharge valve, the pump envelope configured to enable the seal gas to displace corrosive fumes and a product, and wherein the gas seal column apparatus is configured to control a product level within the pump envelope by changing a pressure of the seal gas.

3. The gas seal column apparatus according to claim 2, wherein the gas seal column includes a plurality of level sensors which detects the product level within the gas seal column, and wherein the plurality of level sensors are positioned at differing heights.

4. The gas seal column apparatus according to claim 3, wherein the plurality of level sensors include a first level sensor, a second level sensor, a third level sensor, and a fourth level sensor;

wherein the first level sensor is located at a lowest level of the gas seal column and above a lowest level of the product needed for the pump to prime, and when activated, signals that the product has entered the gas seal column and the pump is primed for operation;

wherein the second level sensor is located above the first level sensor, and when activated, signals that an increase in the pressure of the seal gas is needed;

wherein the third level sensor is located above the second level sensor, and when activated, signals that a further increase in the pressure of the seal gas is needed and closes the discharge valve to further increase the pressure of the seal gas; and wherein the fourth level sensor is located above the third level sensor, and when activated, initiates a controlled shutdown of the pump or the entire apparatus.

5. The gas seal column apparatus according to claim 4, further comprising:

a control box to monitor the product level, to report the product level, to control the product level, and to operate the pump, wherein the control box monitors the product level via inputs from the plurality of level sensors.

6. The gas seal column apparatus according to claim 5, wherein the control box controls the product level by opening and closing a first inlet valve, a second inlet valve, a third inlet valve, the discharge valve, or combinations thereof.

7. The gas seal column apparatus according to claim 6, wherein the gas seal column further comprises a plurality of splash quieting discs, a plurality of anti-rotation panels, or a combination thereof to control motion of the product within the gas seal column.

8. The gas seal column apparatus according to claim 7, wherein the gas seal column further includes a telescoping, corrosion-resistant, lined gas seal column for elevated temperature conditions, and wherein the pump drive motor, the telescoping corrosion-resistant, lined gas seal column, and the pump define a sealed, vertically-oriented, pumping system.

9. The gas seal column apparatus according to claim 8, wherein a top mounting panel of the gas seal column is configured to receive a shaft seal to seal the gas seal column.

10. The gas seal column apparatus according to claim 9, wherein the pump includes a main impeller.

11. The gas seal column apparatus according to claim 10, wherein the pump further includes an auxiliary impellor coupled to the main impellor, wherein the auxiliary impellor is larger in diameter than the main impeller, wherein the auxiliary impellor is located closer to the gas seal column than the main impeller, and wherein the auxiliary impellor is operable as a hydrodynamic shaft seal to restrain or prevent the flow of the product into the gas seal column during pumping operations.

12. A gas seal column apparatus, comprising:

a pump drive motor;

a gas seal column configured to receive a seal gas for pressurizing the gas seal column;

a vertically-oriented pump system comprising a pump and the gas seal column, coupled to the pump drive motor and configured to move a product through the pump; and a plurality of level sensors to detect a level of the product in the gas seal column and any fumes in the gas seal column; and a fully sealed motor housing configured without a gas seal inlet pipe.

13. The apparatus according to claim 12, wherein the gas seal column includes an inlet pipe connection through which the seal gas enters the gas seal column.

14. The apparatus according to claim 13, wherein the gas seal column comprises a discharge pipe connection through which the seal gas exits the gas seal column via a discharge valve.

15. The apparatus according to claim 14, wherein the plurality of level sensors are positioned at different heights.

16. The apparatus according to claim 15, wherein the plurality of level sensors includes a first level sensor, a second level sensor, a third level sensor, and a fourth level sensor, wherein:

the first level sensor is at a lowest level of the gas seal column and above a lowest level of product needed for the pump to prime, and when activated, signals that the product has entered the gas seal column, and the pump is primed for operation;

the second level sensor is above the first level sensor, and when activated, signals that an increase in a pressure of the seal gas is needed;

the third level sensor is above the second level sensor, and when activated, signals that a further increase in the pressure of the seal gas is needed and closes the discharge valve to further aid in increasing seal gas pressure; and the fourth level sensor is above the third level sensor, and when activated, initiates a controlled shutdown of the pump.

17. The apparatus according to claim 12, wherein the gas seal column comprises a plurality of splash quieting discs, a plurality of anti-rotation panels, or combinations thereof to control motion of the product within the gas seal column.

18. The apparatus according to claim 12, further comprising a control box configured to monitor the product level via inputs from the plurality of level sensors, reports the product level, and controls the product level and operation of the pump.

19. The apparatus according to claim 18, wherein the control box controls the product level by opening and closing one or more valves.

20. The apparatus according to claim 12, wherein the pump includes a main impeller and an auxiliary impeller.

21. The gas seal column apparatus according to claim 14, further comprising an inlet pipe connection that enables the seal gas to enter the pump envelope, and an outlet pipe connection that enables the seal gas to exit the pump envelope via the discharge valve, the pump envelope configured to enable the seal gas to displace corrosive fumes and a product, and wherein the gas seal column apparatus is configured to control a product level within the pump envelope by changing a pressure of the seal gas.

22. The gas seal column apparatus according to claim 21, wherein the gas seal column includes a plurality of level sensors which detects the product level within the gas seal column, and wherein the plurality of level sensors are positioned at differing heights.

* * * * *